US007564452B2

(12) United States Patent
Komiya

(10) Patent No.: US 7,564,452 B2
(45) Date of Patent: Jul. 21, 2009

(54) ORGANIC ELECTROLUMINESCENT DISPLAY

(75) Inventor: Naoaki Komiya, Suwon-si (KR)

(73) Assignee: Samsung Mobile Display Co., Ltd., Yongin, Gyunggi-Do (KR)

( * ) Notice: Subject to any disclaimer, the term of this patent is extended or adjusted under 35 U.S.C. 154(b) by 424 days.

(21) Appl. No.: 11/412,125

(22) Filed: Apr. 27, 2006

(65) Prior Publication Data

US 2006/0244695 A1 Nov. 2, 2006

(30) Foreign Application Priority Data

Apr. 29, 2005 (KR) ..... 10-2005-0036394

(51) Int. Cl.
*G09G 5/00* (2006.01)

(52) U.S. Cl. ..... 345/204; 345/46; 345/82; 345/98; 315/169.1; 315/291

(58) Field of Classification Search ..... 315/169.1, 315/169.3, 291; 345/44–46, 55, 76, 82, 98, 345/204, 205
See application file for complete search history.

(56) References Cited

U.S. PATENT DOCUMENTS

| | | | | |
|---|---|---|---|---|
| 6,909,242 | B2 * | 6/2005 | Kimura | 315/169.3 |
| 7,091,938 | B2 * | 8/2006 | Inukai et al. | 345/76 |
| 7,239,309 | B2 * | 7/2007 | Smith et al. | 345/207 |
| 2005/0041002 | A1 * | 2/2005 | Takahara et al. | 345/76 |

FOREIGN PATENT DOCUMENTS

| | | |
|---|---|---|
| JP | 2003-195808 | 7/2003 |
| JP | 2003-216100 | 7/2003 |
| JP | 2004-012897 | 1/2004 |
| KR | 10-2004-0070043 | 8/2004 |
| KR | 10-2004-0078437 | 9/2004 |
| WO | WO04/001714 | 12/2003 |

OTHER PUBLICATIONS

Korean Office Action for Korean Patent Application No. 2005-0036394, issued on Oct. 25, 2006.
Office action from the Japanese Patent Office issued in Applicant's corresponding Japanese Patent Application No. 2005-255921 dated Jun. 24, 2008.

* cited by examiner

*Primary Examiner*—Haissa Philogene
(74) *Attorney, Agent, or Firm*—Robert E. Bushnell, Esq.

(57) ABSTRACT

An organic electroluminescent display supplies a reverse bias voltage to an Organic Light-Emitting Diode (OLED) for emitting light. The organic electroluminescent display additionally includes a reverse bias transistor to supply the reverse bias voltage. The reverse bias transistor is connected between an anode of the OLED and a reverse bias power supply, between the anode of the OLED and a first power line supplying a positive source voltage, or between the anode of the OLED and a data line. Furthermore, the reverse bias transistor can be connected between an initialization line and the anode of the OLED. The reverse bias voltage is supplied to the OLED before displaying an image or within a non-display period of a vertical synchronous signal, thereby enabling detection of whether or not the OLED has a defect.

25 Claims, 12 Drawing Sheets

ORGANIC ELECTROLUMINESCENT DISPLAY

CLAIM OF PRIORITY

This application makes reference to, incorporates the same herein, and claims all benefits accruing under 35 U.S.C. §119 from an application for ORGANIC ELECTROLUMINESCENT DISPLAY earlier filed in the Korean Intellectual Property Office on 29 Apr. 2005 and there duly assigned SER. No. 10-2005-0036394.

BACKGROUND OF THE INVENTION

1. Field of the Invention

The present invention relates to an organic electroluminescent display, and more particularly, to an organic electroluminescent display with a pixel circuit for supplying a reverse bias voltage to an Organic Light-Emitting Diode (OLED) provided in a pixel.

2. Description of the Related Art

An organic electroluminescent display displays an image by supplying a data signal to a self-emissive OLED, and is classified as either a passive matrix or an active matrix organic electroluminescent display according to a driving method.

In a passive matrix organic electroluminescent display, anodes and cathodes of an image display region intersect in the form of a grid, and a pixel is formed in a region where the anode and the cathode intersect each other.

On the other hand, in an active matrix organic electroluminescent display, thin film transistors are disposed in respective pixels to control each pixel.

The biggest difference between the passive matrix organic electroluminescent display and the active matrix organic electroluminescent display is the emission time of the organic electroluminescent display. That is, the passive matrix organic electroluminescent display makes an organic emission layer emit light momentarily with a high brightness, while the active matrix organic electroluminescent display makes the organic emission layer emit light continuously with a low brightness.

In the passive matrix organic electroluminescent display, the momentary emission brightness must increase as the resolution increases. The high brightness deteriorates the organic electroluminescent display. On the contrary, in the active matrix organic electroluminescent display, the thin film transistor is used in driving the pixel, and the pixel emits light continuously in one frame, so that the active matrix organic electroluminescent display can be driven by a low current. Therefore, the active matrix organic electroluminescent display has advantages in that parasitic capacitance and power consumption are low compared to the passive matrix organic electroluminescent display.

However, the active matrix organic electroluminescent display has non-uniform brightness. In general, the active matrix organic electroluminescent display employs a Low-Temperature Polysilicon (LTPS) thin film transistor as an active device. The LTPS thin film transistor is crystallized by supplying a laser to amorphous silicon formed at a low temperature.

The characteristics of the thin film transistor vary depending on the crystallization. For example, the threshold voltage, etc. of the thin film transistor is not uniform for all pixels. Thus, the pixels display different brightness with regard to the same data signal, thereby allowing the whole image display region to have non-uniform brightness. Various attempts have been made to solve the non-uniform brightness problem.

The non-uniform brightness problem can be solved by compensating for the characteristics of a driving transistor. Methods of compensating for the characteristics of the driving transistor are broadly divided into two categories according to a driving method. That is, there is a voltage programming method and a current programming method.

In the voltage programming method, a voltage corresponding to the threshold voltage of the driving transistor is stored in a capacitor, and the threshold voltage of the driving transistor is compensated for by the stored voltage.

In the current programming method, a current is supplied as the data signal, and a voltage difference between a source and a gate of the driving transistor corresponding to the supplied current is stored in the capacitor. Then, the driving transistor is connected to a power supply, so that a driving current corresponding to the supplied current flows in the driving transistor. Thus, the driving current supplied to the organic emission layer is corresponding to the current supplied as the data signal, regardless of the different characteristics of the driving transistors. Therefore, the brightness problem is reduced.

However, the foregoing methods for improving the brightness problem are based on the assumption that the organic electroluminescent display has a normal organic emission layer. If the organic emission layer has defects, such as a pinhole formed in a fabrication process, the organic electroluminescent display cannot emit light normally even though a difference in characteristics of the driving transistors is compensated for.

In the case of the organic electroluminescent display having defects like as a mura, the defects are generally detected by examining a displayed image of the organic electroluminescent display while the organic electroluminescent display is operated normally. However, this method cannot check for progressive defects in the organic electroluminescent display, and must drive a plurality of transistors corresponding to the pixels.

Accordingly, there is a demand for an organic electroluminescent display whose pixels can be electrically checked for defects without having to display an image.

SUMMARY OF THE INVENTION

The present invention provides an organic electroluminescent display which applies a reverse bias voltage to an Organic Light-Emitting Diode (OLED).

In an exemplary embodiment of the present invention, an organic electroluminescent display formed in a region where a scan line and a data line intersect each other includes: a pixel driving part connected to a first power line, receiving a scan signal from the scan line, and generating a driving current corresponding to a data signal received from the data line; an OLED connected between the pixel driving part and a second power line, and emitting light in response to the driving current; and a reverse bias transistor connected between an anode of the OLED and a reverse bias power supply.

In another exemplary embodiment of the present invention, an organic electroluminescent display includes: a pixel driving part connected to a first power line, receiving a scan signal from a scan line, and generating a driving current corresponding to a data signal received from a data line; an OLED connected between the pixel driving part and a second power line and emitting light in response to the driving current; and a reverse bias transistor connected between an anode of the OLED and the first power line, and supplying a reverse bias voltage to the OLED.

In still another exemplary embodiment of the present invention, an organic electroluminescent display includes: a pixel driving part connected to a first power line, receiving a scan signal from a scan line, and generating a driving current corresponding to a data signal received from a data line; an OLED connected between the pixel driving part and a second power line, and emitting light in response to the driving current; a first reverse bias transistor connected between an anode of the OLED and the data line, and supplying a reverse bias voltage to the OLED; and a second reverse bias transistor connected between the data line and a reverse bias power supply, and supplying the reverse bias voltage to the first reverse bias transistor.

In yet another exemplary embodiment of the present invention, an organic electroluminescent display includes: a pixel driving part connected to a first power line, receiving an initialization signal through an initialization line in response to a previous scan signal, receiving a data signal from a data line in response to a current scan signal, and generating a driving current corresponding to the received data signal; an OLED connected between the pixel driving part and a second power line, and emitting light in response to the driving current; and a reverse bias transistor connected between the initialization line and an anode of the OLED, and supplying a reverse bias voltage to the OLED.

BRIEF DESCRIPTION OF THE DRAWINGS

A more complete appreciation of the present invention, and many of the attendant advantages thereof, will be readily apparent as the present invention becomes better understood by reference to the following detailed description when considered in conjunction with the accompanying drawings in which like reference symbols indicate the same or similar components, wherein.

DETAILED DESCRIPTION OF THE INVENTION

Figure 1:
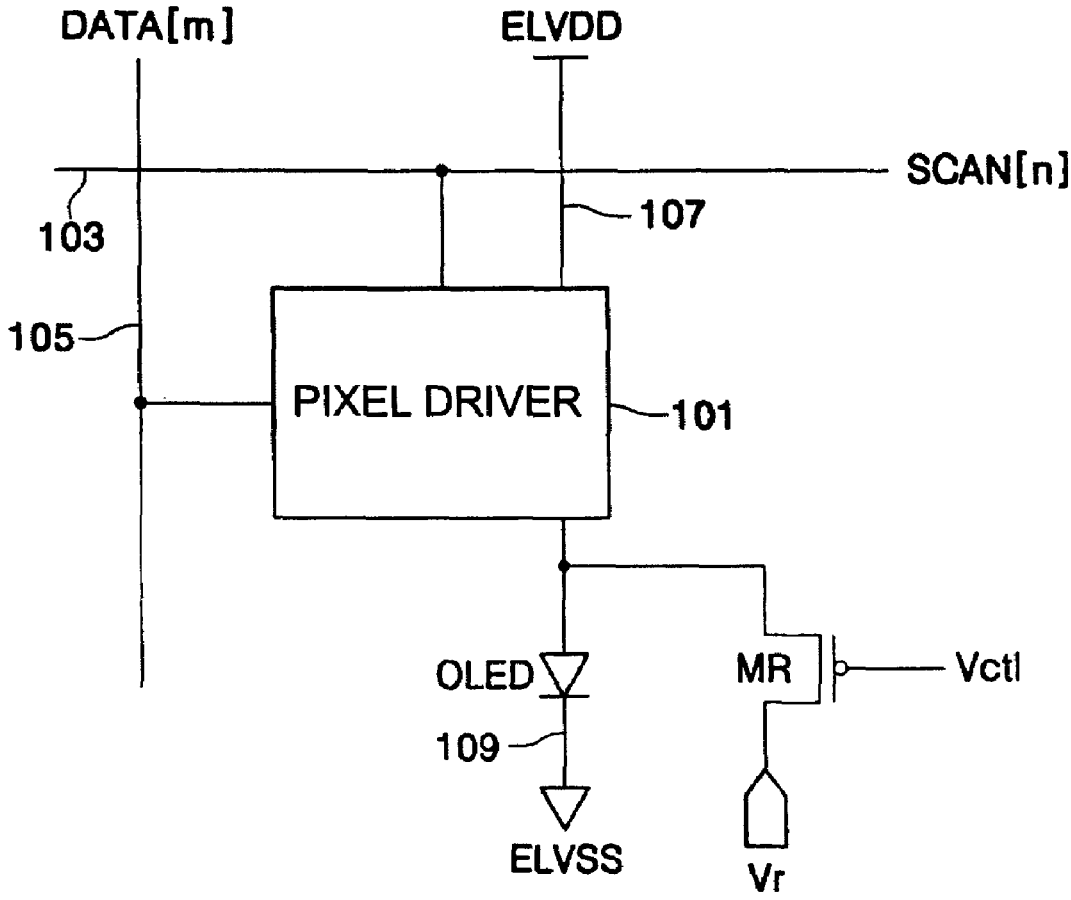
FIG. 1 is a block diagram of an organic electroluminescent display according to a first embodiment of the present invention.

FIG. 1 is a block diagram of an organic electroluminescent display according to a first embodiment of the present invention.

Referring to FIG. 1, the organic electroluminescent display according to the first embodiment of the present invention includes a pixel driving part 101, an OLED, and a reverse bias transistor MR.

The pixel driving part 101 includes a plurality of transistors and a capacitor. Furthermore, the pixel driving part 101 is formed in a region where a scan line 103 intersects a data line 105. When a scan signal SCAN[n] is supplied from the scan line 103, the pixel driving part 101 is selected and a data signal DATA[m] is supplied to the selected pixel driving part 101. The data signal DATA[m] is supplied to the pixel driving part 101 through the data line 105. The data signal DATA[m] supplied to the pixel driving part 101 is stored as a voltage in the capacitor provided in the pixel driving part 101. Alternatively, the data signal DATA[m] can be supplied as a current to the pixel driving part 101, or supplied by sinking a predetermined current from the pixel driving part 101.

Furthermore, the pixel driving part 101 is electrically connected to a first power line 107 supplied a positive source voltage ELVDD. Thus, the pixel driving part 101 receives power for generating a driving current through the first power line 107.

Also, the pixel driving part 101 receives an emission control signal and controls the driving current to be applied to the OLED.

The OLED is connected between the pixel driving part 101 and a second power line 109 supplying a negative source voltage ELVSS. The OLED receives the driving current corresponding to the data signal DATA[m] supplied to the pixel driving part 101 and emits light of a predetermined brightness.

The reverse bias transistor MR is connected between an anode of the OLED and a reverse bias power supply Vr. Furthermore, the reverse bias transistor MR has a gate electrode to which a reverse bias control signal Vct1 is applied.

A reverse bias voltage can be supplied to the OLED before or after the OLED starts emitting light, as the data signal DATA[m] is supplied to the organic electroluminescent display. That is, the reverse bias voltage is supplied to the OLED during a non-display period, i.e., the rest of an operation period excluding a period during which the organic electroluminescent display displays an image. Hereinafter, the term "during some period" may mean "during the entire period, a portion thereof, or a moment therein". In other words, when the reverse bias control signal Vct1 having a low level is supplied during the non-display period, the reverse bias transistor MR is turned on and thus the reverse bias voltage is supplied to the anode of the OLED through the reverse bias transistor MR. Preferably, a voltage difference between the anode and the cathode of the OLED ranges from −14V to −10V. More preferably, a voltage difference between the anode and the cathode of the OLED is about −12V.

Furthermore, before the organic electroluminescent display starts emitting light normally, the reverse bias voltage can be supplied in order to detect in advance whether or not the OLED is defective.

For example, in the case of the OLED having normal characteristics, the OLED to which the reverse bias voltage is supplied has no leakage current. On the contrary, in the case of the OLED being defective, there is a leakage current due to the reverse bias voltage. Thus, it is possible to check whether or not the OLED is defective on the basis of the leakage current due to the reverse bias voltage.

Figure 2A:
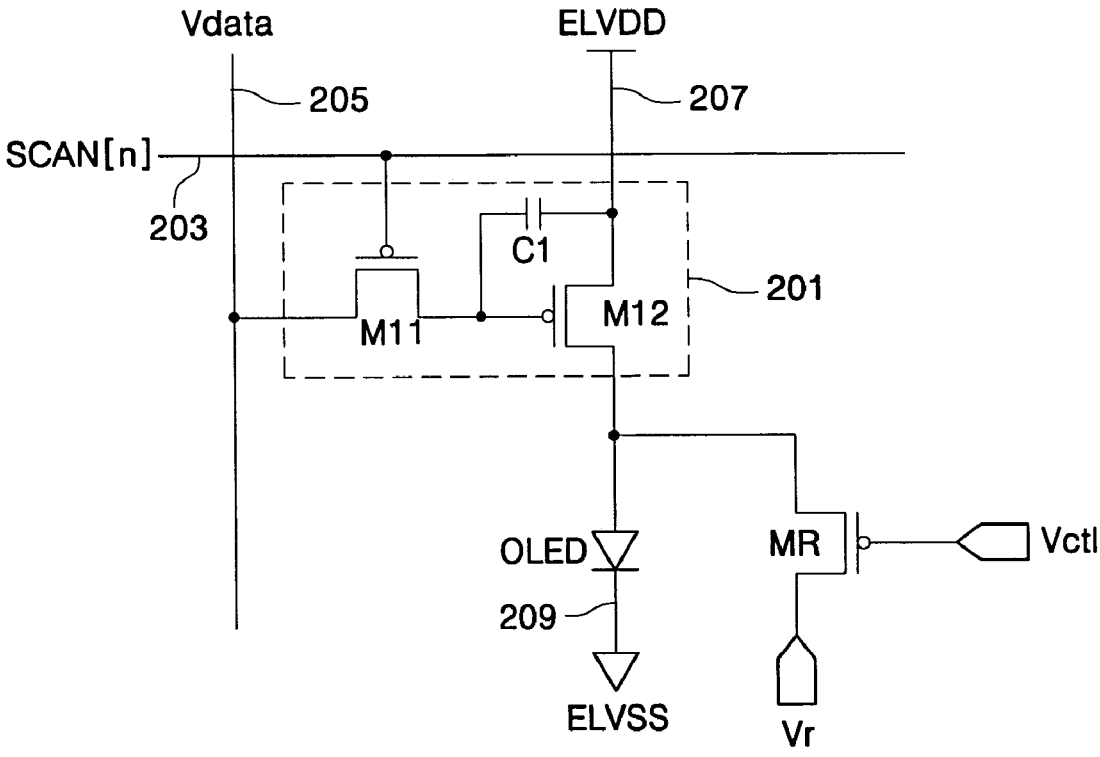
FIGS. 2A and 2B are circuit diagrams of the organic electroluminescent display according to the first embodiment of the present invention.
Figure 2B:
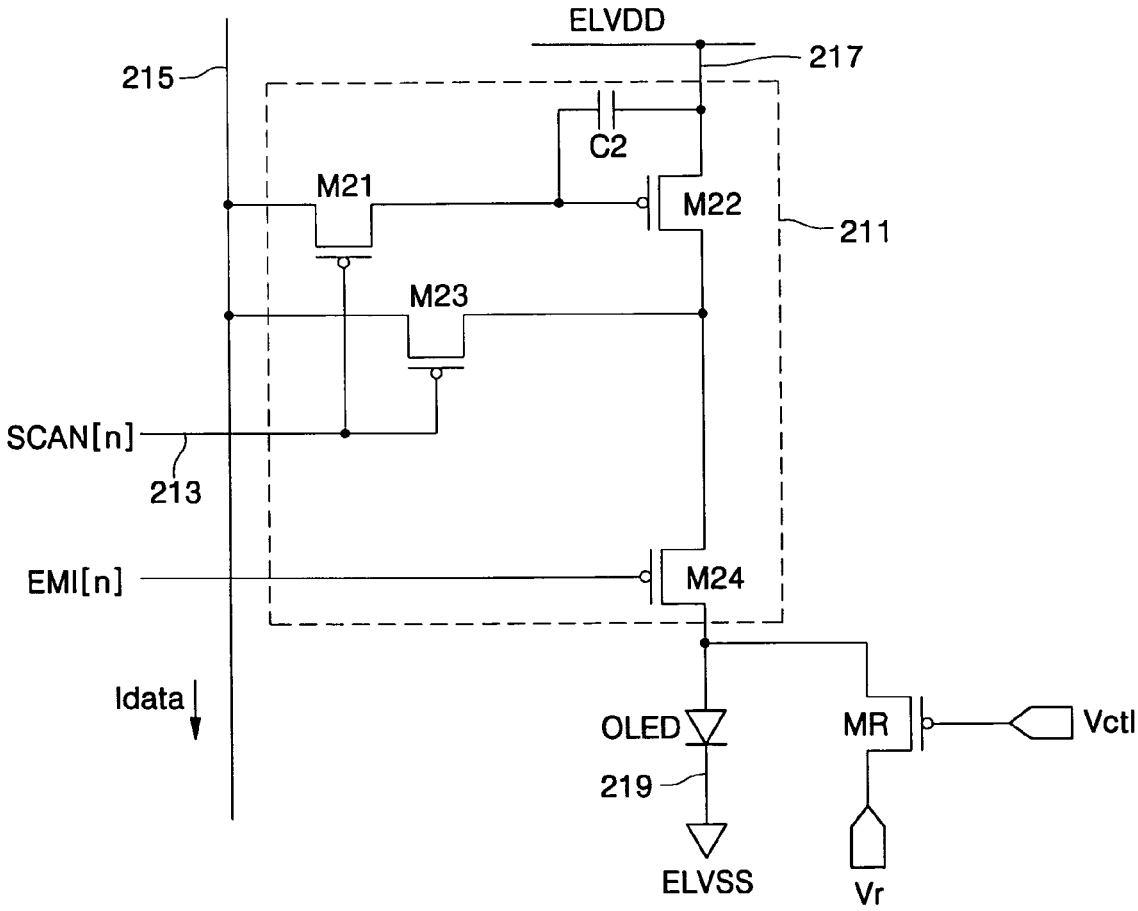

FIGS. 2A and 2B are circuit diagrams of the organic electroluminescent display according to the first embodiment of the present invention.

Referring to FIG. 2A, the organic electroluminescent display according to the first embodiment of the present invention includes a pixel driving part 201, an OLED, and a reverse bias transistor MR.

The pixel driving part 201 includes a switching transistor M11, a capacitor C1, and a driving transistor M12.

The switching transistor M11 has a first electrode connected to a data line 205, a second electrode connected to a gate electrode of the driving transistor M12, and a gate electrode connected to a scan line 203. The switching transistor M11 is turned on/off in response to a scan signal SCAN[n] supplied through the scan line 203. When the switching transistor M11 is turned on by the scan signal SCAN[n], a data voltage Vdata is supplied from the data line 205 to the driving transistor M12 and the capacitor C1.

The capacitor C1 is connected between the second electrode of the switching transistor M11 and a first power line 207. The capacitor C1 is used to store the data voltage Vdata supplied via the switching transistor M11, and thus a driving current corresponding to the stored data voltage Vdata is generated.

The driving transistor M12 is connected between the first power line 207 and the OLED. Furthermore, the driving transistor M12 has the gate electrode connected to both the capacitor C1 and the second electrode of the switching transistor M11, a first electrode connected to the first power line 207, and a second electrode connected to the anode of the light-emitting diode. A voltage difference between the source electrode and the gate electrode of the driving transistor M12 is equal to a voltage difference stored the capacitor.

The OLED is connected between the second electrode of the driving transistor M12 provided in the pixel driving part 201 and a second power line 209 supplying a negative source voltage ELVSS. The OLED emits light in response to the driving current generated by the driving transistor M12 of the pixel driving part 201.

The reverse bias transistor MR is connected between a reverse bias power supply Vr and an anode of the OLED. Furthermore, the reverse bias transistor MR has a gate electrode to which a reverse bias control signal Vct1 is supplied. The reverse bias control signal Vct1 controls the reverse bias transistor MR to be turned on during a period during which the OLED does not operate. That is, before the organic electroluminescent display starts emitting light normally, a reverse bias voltage can be supplied in order to check in advance whether or not the OLED is defective. Furthermore, the reverse bias voltage can be supplied in a non-display period of a vertical synchronous signal.

FIG. 2B illustrates a current programming type organic electroluminescent display in which a voltage Vgs corresponding to a data current Idata sunk to a data driver is stored in a capacitor, and a current equal to the data current Idata is supplied to an OLED when the OLED emits light.

The current programming type organic electroluminescent display has a pixel driver 211, the OLED, and a reverse bias transistor MR.

The pixel driving part 211 includes a first switching transistor M21, a capacitor C2, a driving transistor M22, a second switching transistor M23, and an emission control transistor M24.

The first switching transistor M21 is turned on/off in response to a scan signal SCAN[n] supplied through a scan line 213. Furthermore, the first switching transistor M21 has a first electrode connected to a data line 215, and a second electrode connected to both the capacitor C2 and the driving transistor M22.

The capacitor C2 is connected between a first power line 217 supplying a positive source voltage ELVDD and the second electrode of the first switching transistor M21.

The driving transistor M22 is connected between the first power line 217 and the emission control transistor M24. Furthermore, the driving transistor M22 has a gate electrode connected to both the second electrode of the switching transistor M21 and the capacitor C2, a first electrode connected to the first power line 217, and a second electrode connected to the emission control transistor M24. The second switching transistor M23 is turned on/off in response to the scan signal SCAN[n]. Furthermore, the second switching transistor M23 has a first electrode connected to the second electrode of the driving transistor M22, and a second electrode connected to the data line 215.

In the case of the data current Idata being programmed in the pixel driving part 211, the first and second switching transistors M21 and M23 are turned on by the scan signal SCAN[n]. Furthermore, the data current Idata is sunk by the data driver. Thus, the data current Idata flows to the data line 215 via the second switching transistor M23. Furthermore, the data current Idata is supplied through the first power line 217 and the driving transistor M22. Therefore, the capacitor C2 is charged with a voltage Vgs corresponding to the data current Idata.

The emission control transistor M24 is connected between the driving transistor M22 and the OLED. The emission control transistor M24 is turned on/off in response to an emission control signal EMI[n] supplied to a gate electrode thereof. The emission control transistor M24 has a first electrode connected to both the driving transistor M22 and the second switching transistor M23, and a second electrode connected to an anode of the OLED. When the emission control transistor M24 is turned on by the emission control signal EMI[n], the data signal Idata stored as a voltage in the capacitor C2 flows to the OLED, and thus the OLED starts emitting light.

The OLED is connected between the second electrode of the emission control transistor M24 and a second power line 219 supplying a negative source voltage ELVSS. The OLED emits light in response to a driving current.

The reverse bias transistor MR is connected between the anode of the OLED and a reverse bias power supply Vr. Furthermore, the reverse bias transistor MR has a gate electrode to which a reverse bias control signal Vct1 is supplied. The reverse bias transistor MR is turned on/off in response to the reverse bias control signal Vct1.

The reverse bias transistor MR is turned on before the organic electroluminescent display starts emitting light normally, so that a reverse bias voltage is supplied to the OLED, thereby checking whether or not the OLED is defective. Furthermore, the reverse bias voltage can be supplied within a non-display period while a vertical synchronous signal is supplied.

Figure 3:
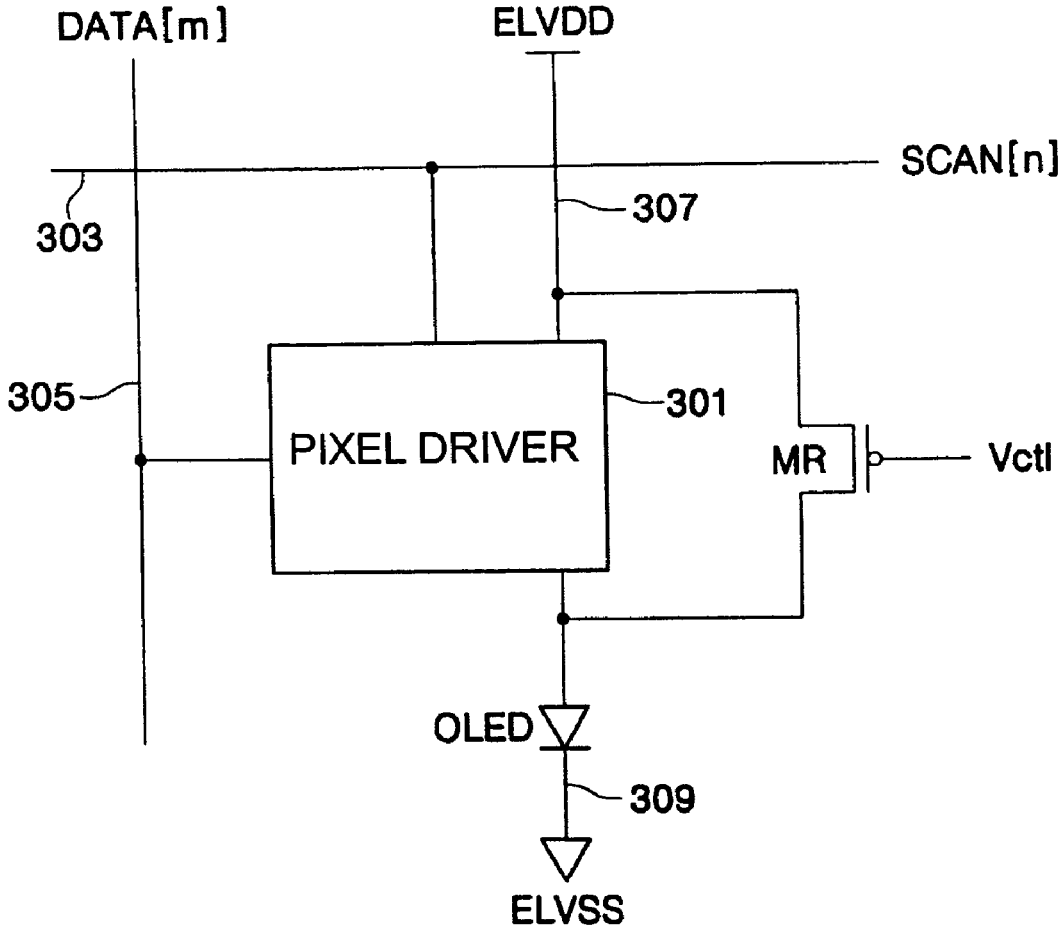
FIG. 3 is a block diagram of an organic electroluminescent display according to a second embodiment of the present invention.

FIG. 3 is a block diagram of an organic electroluminescent display according to a second embodiment of the present invention.

Referring to FIG. 3, the organic electroluminescent display according to the second embodiment of the present invention includes a pixel driving part 301, an OLED, and a reverse bias transistor MR.

The pixel driving part 301 includes a plurality of transistors and a capacitor. Furthermore, the pixel driving part 301 is formed in a region where a scan line 303 intersects a data line 305. When a scan signal SCAN[n] is supplied from the scan line 303, the pixel driving part 301 is selected and a data signal DATA[m] is supplied to the selected pixel driving part 301. The data signal DATA[m] is supplied to the pixel driving part 301 through the data line 305. The data signal DATA[m] supplied to the pixel driving part 301 is stored as a voltage in the capacitor provided in the pixel driving part 301. Alternatively, the data signal DATA[m] can be supplied as a current to the pixel driving part 301, or supplied by sinking a predetermined current from the pixel driving part 301.

Furthermore, the pixel driving part 301 is connected to a first power line 307 supplying a positive source voltage ELVDD. Thus, the pixel driving part 301 receives power for generating a driving current through the first power line 307.

Also, the pixel driving part 301 receives an emission control signal and controls the driving current to be applied to the OLED.

The OLED is connected between the pixel driving part 301 and a second power line 309 supplying a negative source voltage ELVSS. The OLED receives the driving current corresponding to the data signal DATA[m] supplied to the pixel driving part 301, and emits light with a predetermined brightness.

The reverse bias transistor MR is connected between an anode of the OLED and the first power line 307. Furthermore, the reverse bias transistor MR has a gate electrode to which a reverse bias control signal Vct1 is supplied. For example, when the reverse bias transistor MR is turned on by the reverse bias control signal Vct1, a voltage having a low level instead of the positive source voltage ELVDD is supplied to the first power line 307, and a voltage having a high level instead of the negative source voltage ELVSS is supplied to the second power line 309. Therefore, when the reverse bias transistor MR is turned on, a reverse bias voltage is supplied to the OLED.

The reverse bias voltage can be supplied to the OLED before or after the OLED starts emitting light as the scan signal SCAN[n] and the data signal DATA[m] are supplied to the organic electroluminescent display. That is, the reverse bias voltage is supplied to the OLED during a non-display period, i.e., the rest of an operation period, excluding a period during which the organic electroluminescent display displays an image. In other words, when the reverse bias control signal Vct1 having a low level is supplied during the non-display period, the reverse bias transistor MR is turned on and thus the reverse bias voltage is supplied to the OLED through the reverse bias transistor MR. Preferably, a voltage difference between the anode and the cathode of the OLED ranges from −14V to −10V. More preferably, a voltage difference between the anode and the cathode of the OLED is about −12V.

Furthermore, before the organic electroluminescent display starts emitting light normally, the reverse bias voltage can be supplied in order to detect in advance whether or not the OLED is defective.

For example, in the case of the OLED having normal characteristics, the OLED to which the reverse bias voltage is supplied has no leakage current. On the contrary, in the case of the OLED being defective, there is a leakage current due to the reverse bias voltage. Thus, it is possible to check whether or not the OLED is defective on the basis of the leakage current due to the reverse bias voltage.

Figure 4A:
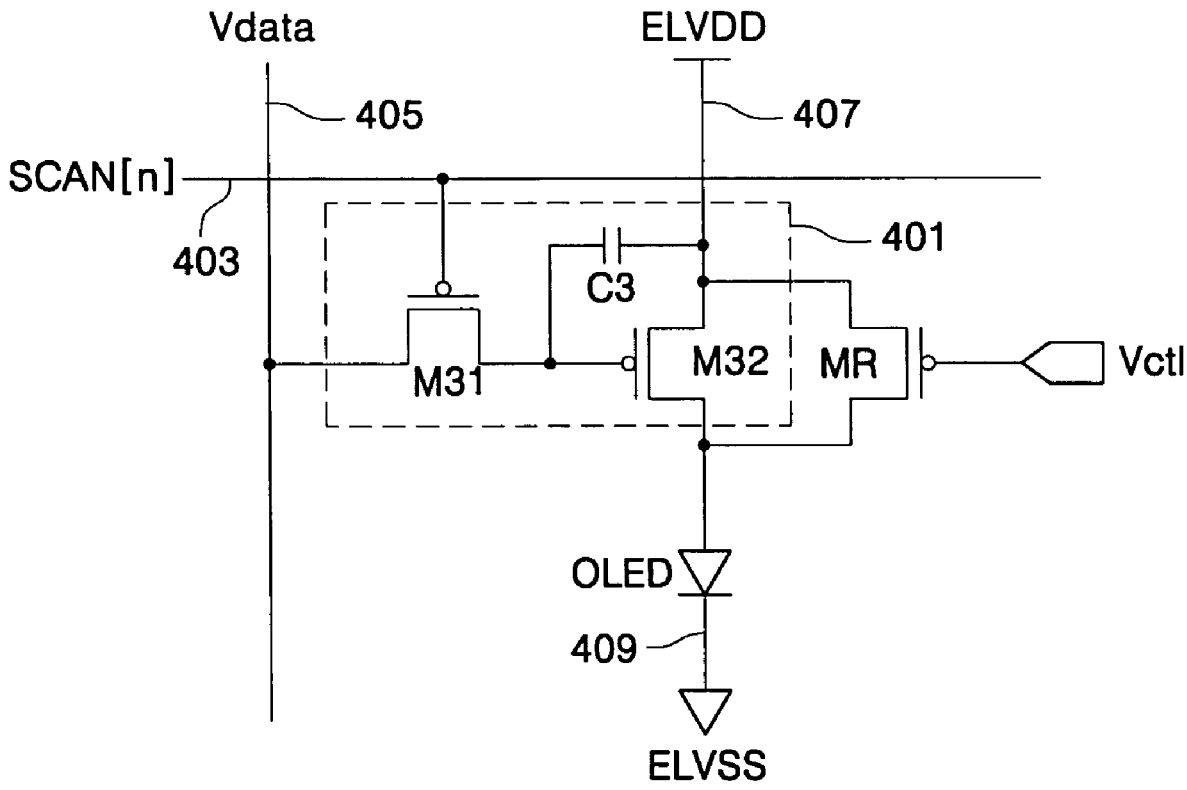
FIGS. 4A and 4B are circuit diagrams of the organic electroluminescent display according to the second embodiment of the present invention.
Figure 4B:
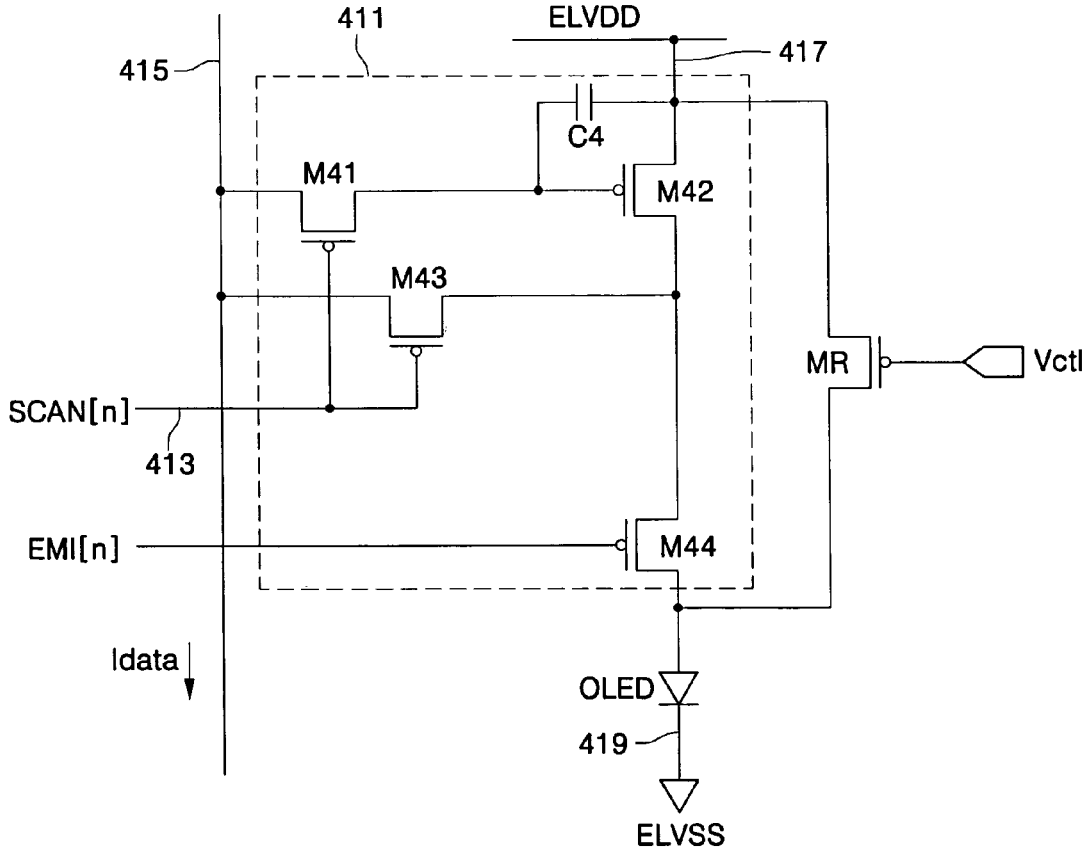

FIGS. 4A and 4B are circuit diagrams of the organic electroluminescent display according to the second embodiment of the present invention.

Referring to FIG. 4A, the organic electroluminescent display according to the second embodiment of the present invention includes a pixel driving part 401, an OLED, and a reverse bias transistor MR.

The pixel driving part 401 includes a switching transistor M31, a capacitor C3, and a driving transistor M32. The configuration and operation of the pixel driving part 401 of FIG. 4A are the same as that of the pixel driving part of FIG. 2A, and a description thereof has not been repeated here. Thus, when the scan signal SCAN[n] and the data signal DATA[m] are respectively supplied through the scan line 403 and the data line 405, the capacitor C3 is charged with a data voltage Vdata.

The OLED is connected between a driving transistor provided in the pixel driving part 401 and a second power line 409. When the OLED emits light normally, the negative source voltage ELVSS is supplied to the second power line 409, and then the OLED emits light in response to a driving current corresponding to the data voltage Vdata stored in the pixel driving part 401.

The reverse bias transistor MR is connected between a first power line 407 and an anode of the OLED, and turned on/off in response to a reverse bias control signal Vct1. When the OLED emits light normally, the positive source voltage ELVDD is supplied to the first power line 407 and the negative source voltage ELVSS is supplied to the second power line 409. However, when the reverse bias transistor MR is turned on by the reverse bias control signal Vct1, a voltage lower than the voltage ELVDD is supplied to the first power line 407 and a voltage higher than the voltage ELVSS is supplied to the second power line 409, thereby supplying the reverse bias voltage to the OLED.

Referring to FIG. 4B, an organic electroluminescent display has a pixel driving part 411 for storing the data current Idata as a voltage and generating a driving current corresponding to the stored voltage, an OLED connected to the pixel driving part 411 and emitting light, and a reverse bias transistor MR connected between an anode of the OLED and a first power line 417.

The pixel driving part 411 includes a first switching transistor M41, a capacitor C4, a driving transistor M42, a second switching transistor M43, and an emission control transistor M44. The configuration and operation of the pixel driving part 411 of FIG. 4B are the same as that of the pixel driving part of FIG. 2B, and a description thereof has not been repeated here. Thus, the first and second switching transistors M41 and M43 are turned on by the scan signal SCAN[n] supplied through the scan line 413, and the data current Idata is sunk from the driving transistor M42 through the data line 415. Then, the capacitor C4 is charged with a voltage Vgs corresponding to the data current Idata. When an emission control signal EMI[n] is supplied, the emission control transistor M44 is turned on, so that a driving current substantially equal to the data current Idata flows in the OLED.

The OLED is connected between the emission control transistor M44 and a second power line 419. In the case of a normal OLED, the negative source voltage ELVSS is supplied to a cathode of the OLED through the second power line 419, and thus the driving current flows in the OLED causing it to emit light. The reverse bias voltage is supplied to the OLED before the OLED is operated normally or within a non-display period.

The reverse bias transistor MR is connected between the anode of the OLED and the first power line 417. The reverse bias transistor MR is turned on/off in response to a reverse bias control signal Vct1. While the reverse bias transistor MR is turned off, the OLED emits light normally. On the other hand, when the reverse bias transistor MR is turned on, the reverse bias voltage is supplied to the OLED.

Figure 5:
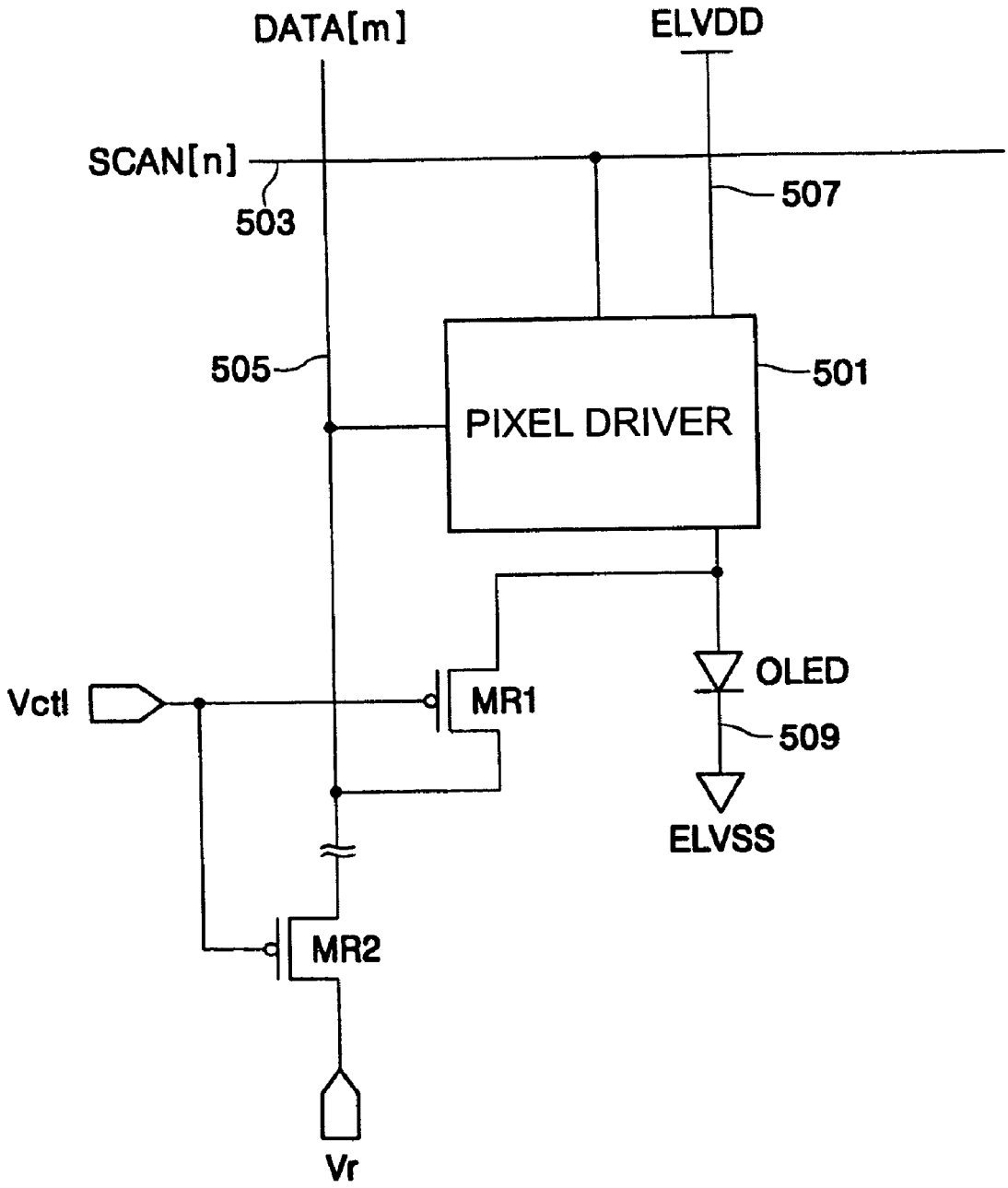
FIG. 5 is a block diagram of an organic electroluminescent display according to a third embodiment of the present invention.

FIG. 5 is a block diagram of an organic electroluminescent display according to a third embodiment of the present invention.

Referring to FIG. 5, the organic electroluminescent display according to the third embodiment of the present invention includes a pixel driving part 501, an OLED, a first reverse bias transistor MR1, and a second reverse bias transistor MR2.

The pixel driving part 501 is selected by a scan signal SCAN[n] supplied through a scan line 503, and receives a data signal DATA[m] through a data line 505. The data signal DATA[m] is either a data voltage or a data current. Furthermore, the pixel driving part 501 is connected to a first power line 507 and supplies a positive source voltage ELVDD from the first power line 507 to the OLED, thereby making the OLED emit light.

The OLED is connected between the pixel driving part 501 and a second power line 509. That is, the OLED has an anode connected to the pixel driving part 501, and a cathode electrode connected to the second power line 509. While the OLED emits light, a negative source voltage ELVSS is supplied to the OLED through the second power line 509.

The first reverse bias transistor MR1 is connected between the anode of the OLED and the data line 505. Furthermore, the first reverse bias transistor MR1 has a gate electrode to which a reverse bias control signal Vct1 is supplied. When the reverse bias control signal Vct1 having a low level is supplied to the first reverse bias transistor MR1, the first reverse bias transistor MR1 is turned on, and thus the data line 505 and the anode of the OLED are electrically connected to each other.

The second reverse bias transistor MR2 is connected between a reverse bias power supply Vr and the data line 505. Furthermore, the second reverse bias transistor MR2 has a gate electrode to which the reverse bias control signal Vct1 is supplied. When the reverse bias control signal Vct1 having a low level is supplied to the second reverse bias transistor MR2, the second reverse bias transistor MR2 is turned on, and thus the data line 505 and the reverse bias power supply Vr are electrically connected to each other. Thus, the reverse bias control signal Vct1 is supplied in common to the first and second reverse bias transistors MR1 and MR2.

When the organic electroluminescent display displays an image, the first reverse bias transistor MR1 and the second reverse bias transistor MR2 are maintained in a turned-off state. Furthermore, the scan signal SCAN[n] is supplied to the pixel driving part 501 through the scan line 503, and the data signal DATA[m] is supplied to the pixel driving part 501 through the data line 505. The pixel driving part 501 generates a driving current in response to the supplied data signal DATA [m], and thus the generated driving current flows in the OLED causing it to start emitting light.

However, during the detection of whether or not the OLED is defective before the organic electroluminescent display displays an image or within a non-display period, the first and second reverse bias transistors MR1 and MR2 are turned on. Then, the reverse bias voltage is supplied to the OLED via the first and second reverse bias transistors MR1 and MR2. That is, the reverse bias power supply Vr is supplied to the anode of the OLED, and therefore the pixel driving part 501 does not generate the driving current.

When the reverse bias voltage is supplied, a voltage difference between the anode and the cathode of the OLED preferably ranges from −14V to −10V. More preferably, the voltage difference between the anode and the cathode of the OLED is about −12V.

Alternatively, the pixel driving part 501 can receive an emission control signal and supply the driving current to the OLED in response to the emission control signal.

Figure 6A:
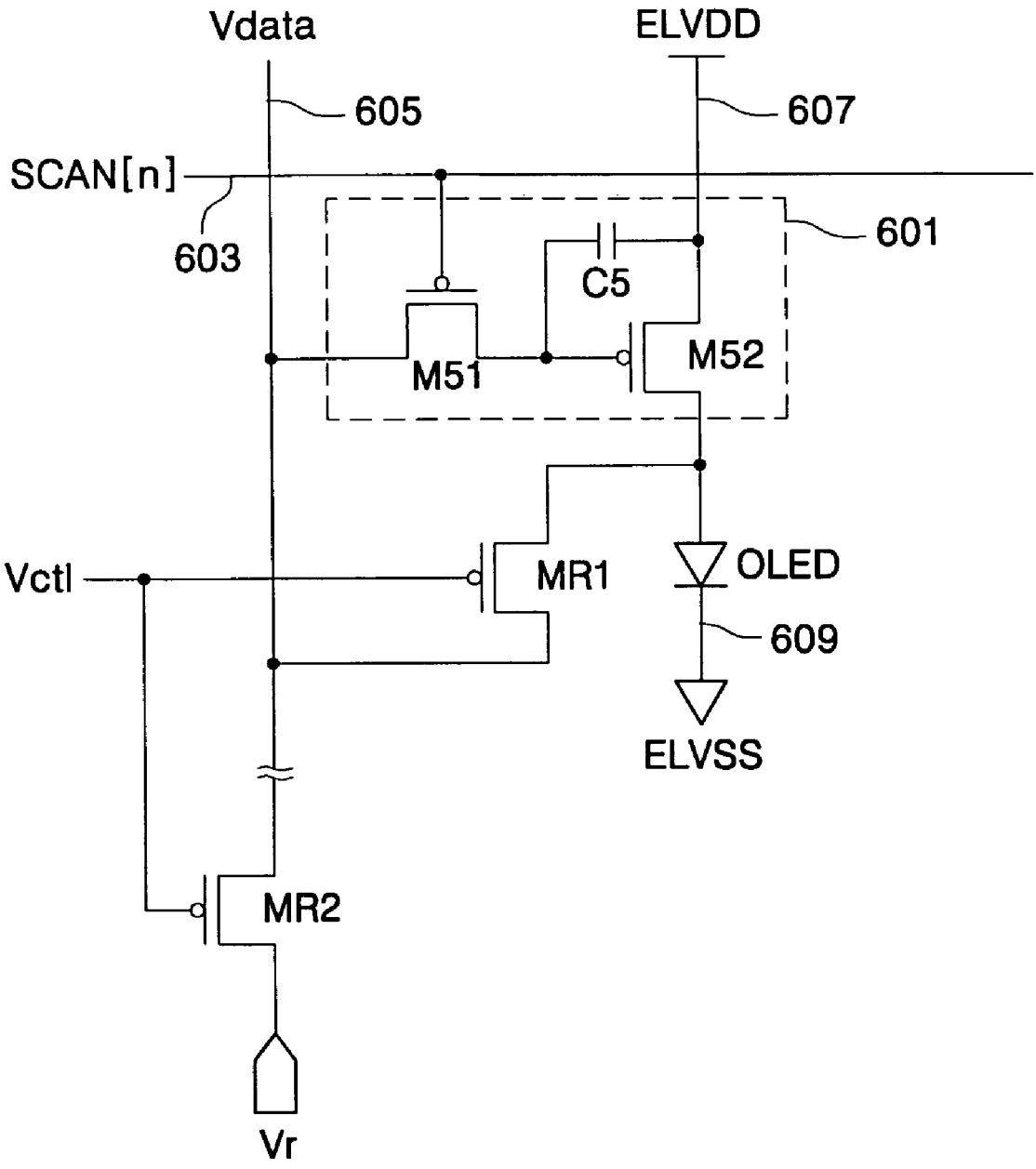
FIGS. 6A and 6B are circuit diagrams of the organic electroluminescent display according to the third embodiment of the present invention.
Figure 6B:
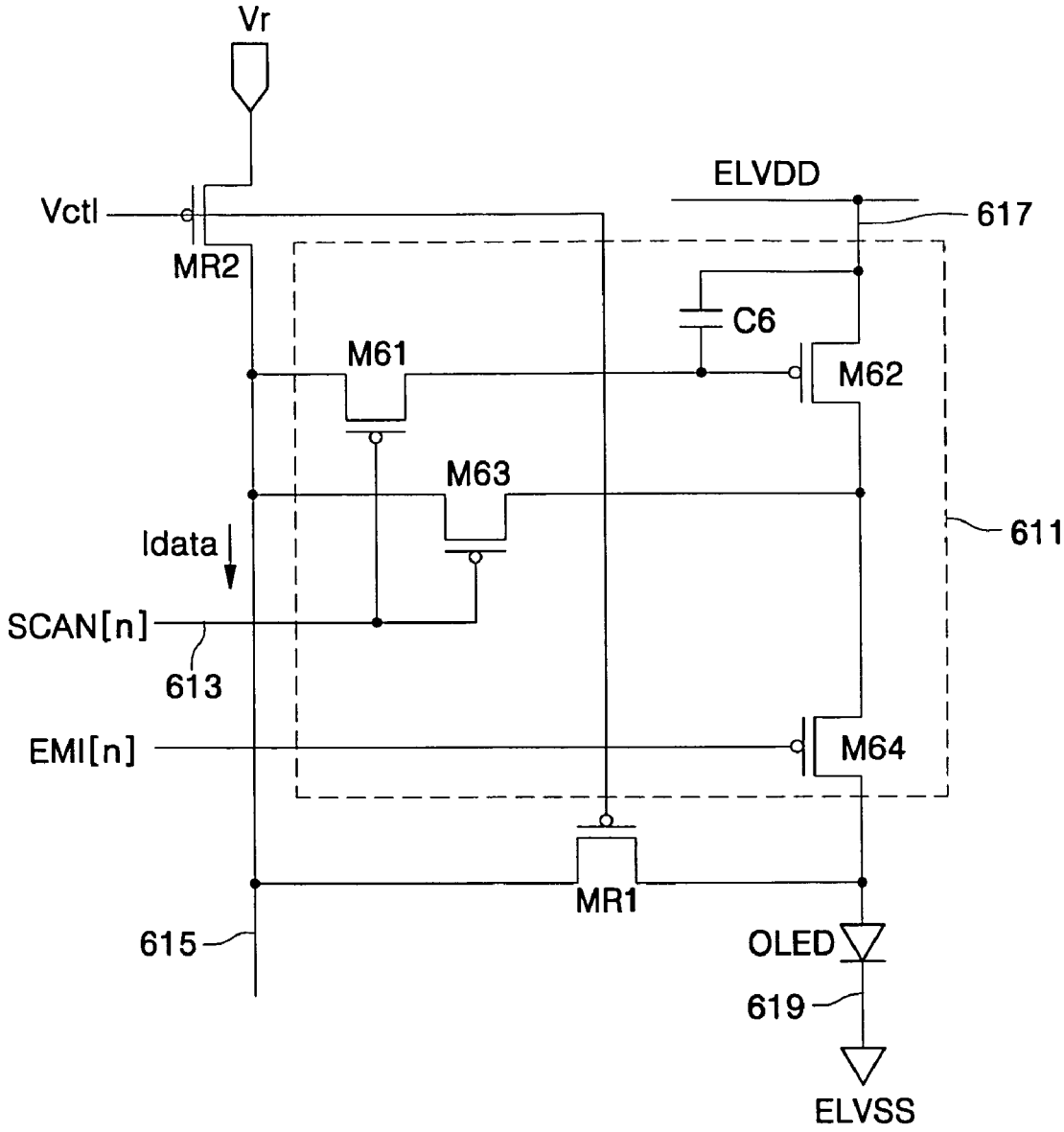

FIGS. 6A and 6B are circuit diagrams of the organic electroluminescent display according to the third embodiment of the present invention.

Referring to FIG. 6A, the organic electroluminescent display according to the third embodiment of the present invention includes a pixel driving part 601, an OLED, a first reverse bias transistor MR1, and a second reverse bias transistor MR2.

The pixel driving part 601 is connected to a first power line 607 supplying a positive source voltage ELVDD and the OLED, and includes a switching transistor M51, a capacitor C5, and a driving transistor M52. The configuration and operation of the pixel driving part 601 of FIG. 6A are the same as that of the pixel driving part of FIG. 2A, and a description thereof has not been repeated here. Thus, when a scan signal SCAN[n] and a data signal DATA[m] are respectively supplied via a scan line 603 and a data line 605, the capacitor C5 is charged with a data voltage Vdata.

The OLED is connected between the driving transistor M52 provided in the pixel driving part 601 and a second power line 609. When the OLED emits light normally, the negative source voltage ELVSS is supplied to the second power line 609, and then the OLED emits light in response to a driving current corresponding to the data voltage Vdata stored in the pixel driving part 601.

The first reverse bias transistor MR1 is connected between the data line 605 and an anode of the OLED, and the second reverse bias transistor MR2 is connected between the data line 605 and a reverse bias power supply Vr.

When the OLED emits light normally, the reverse bias control signal Vct1 is maintained at a high level, and the first and second reverse bias transistors MR1 and MR2 are maintained in a turned-off state. Thus, the reverse bias power supply Vr is electrically disconnected from the OLED, and the OLED emits light in response to the scan signal SCAN[n] and the data voltage Vdata.

In the case where it is detected whether or not the OLED is defective before the organic electroluminescent display displays an image or within a non-display period, the first and second reverse bias transistors MR1 and MR2 are turned on by the reverse bias control signal Vct1. Furthermore, the pixel driving part 601 does not generate a driving current. As the reverse bias transistors are turned on, the reverse bias power supply Vr is supplied to the anode of the OLED, thereby supplying a reverse bias voltage to the OLED.

Referring to FIG. 6B, an organic electroluminescent display has a pixel driving part 611, an OLED, a first reverse bias transistor MR1, and a second reverse bias transistor MR2.

The configuration and operation of the pixel driving part 611 of FIG. 6B is the same as that of the pixel driving part of FIG. 2B, and the description thereof has not been repeated here. Thus, while the OLED emits light, a scan signal SCAN [n] is supplied through a scan line 613, and first and second switching transistors M61 and M63 are turned on by the scan signal SCAN[n]. Furthermore, a capacitor C6 is charged with a voltage Vgs of a driving transistor M62 corresponding to a data current Idata flowing in a data line 615. Furthermore, when an emission control transistor M64 is turned on by an emission control signal EMI[n], the OLED starts emitting light.

In the case where it is detected whether or not the OLED is defective before the organic electroluminescent display displays an image or within a non-display period, the pixel driving part 611 does not generate a driving current. Furthermore, the first and second reverse bias transistors MR1 and MR2 are turned on by a reverse bias control signal Vct1, and a reverse bias power supply Vr is supplied to an anode of the OLED, thereby supplying a reverse bias voltage to the OLED.

Figure 7:
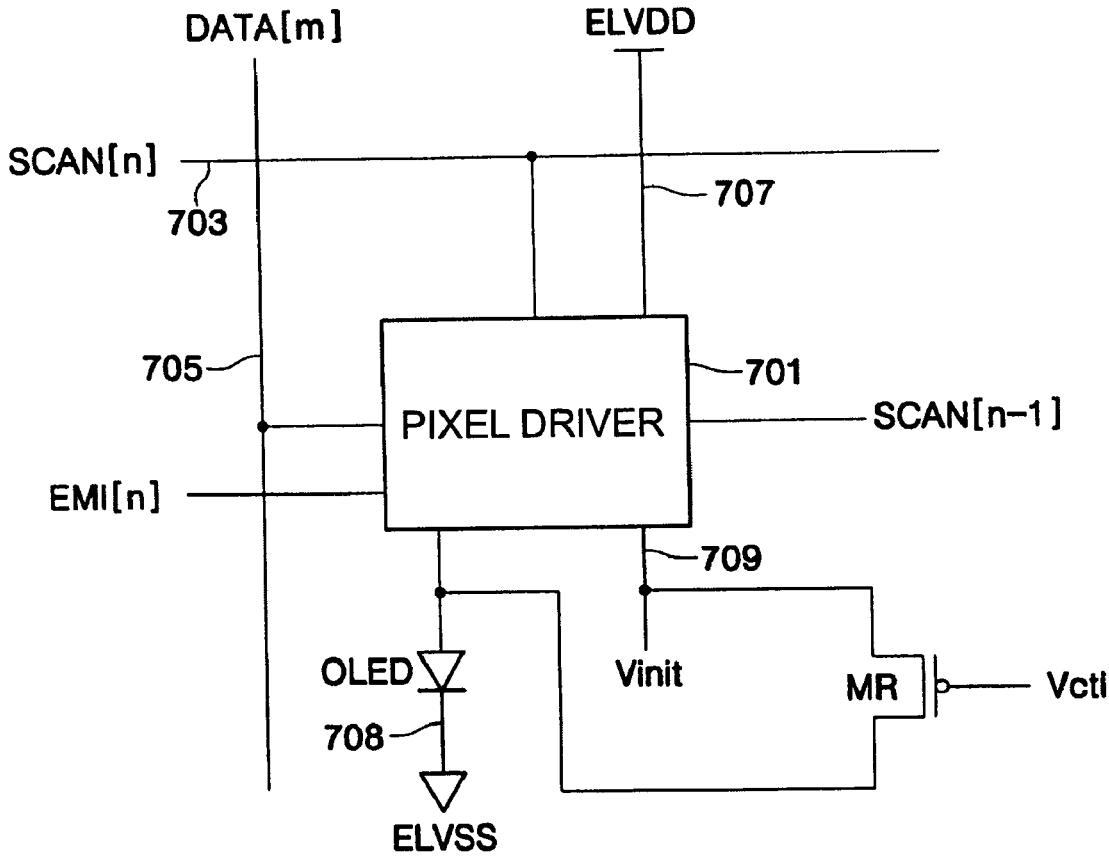
FIG. 7 is a block diagram of an organic electroluminescent display according to a fourth embodiment of the present invention.

FIG. 7 is a block diagram of an organic electroluminescent display according to a fourth embodiment of the present invention.

Referring to FIG. 7, the organic electroluminescent display according to the fourth embodiment of the present invention includes a pixel driving part 701 performing initialization and generating a driving current corresponding to a data signal DATA[m], an OLED emitting light in response to the driving current generated in the pixel driving part 701, and a reverse bias transistor MR supplying a reverse bias voltage to the OLED via an initialization line 709.

The pixel driving part 701 is connected between a first power line 707 supplying a positive source voltage ELVDD and an anode of the OLED. When the OLED emits light, a previous scan signal SCAN[n−1] and an initialization signal Vinit are respectively supplied to the pixel driving part 701 through a previous scan line and the initialization line 709. Furthermore, a current scan signal SCAN[n] is supplied to the pixel driving part 701 via a current scan line 703. The data signal DATA[m] is supplied to the pixel driving part 701 in response to the supplied current scan signal SCAN[n], and then a capacitor provided in the pixel driving part 701 is charged with the data signal DATA[m] supplied through the data line 705. Furthermore, when an emission control signal EMI[n] is supplied, the driving current generated in the pixel driving part 701 flows in the OLED, causing it to start emitting light.

The OLED is connected between the pixel driving part 701 and a second power line 708 supplying a negative source voltage ELVSS. That is, the OLED has the anode connected to the pixel driving part 701, and a cathode electrode connected to the second power line 708.

The reverse bias transistor MR is connected between the initialization line 709 and the anode of the OLED. Furthermore, the reverse bias transistor MR has a gate electrode to which a reverse bias control signal Vct1 is supplied.

When the OLED emits light, the reverse bias control signal Vct1 is maintained at a high level, and the reverse bias transistor MR is maintained in a turned-off state. Thus, the initialization line 709 is electrically disconnected from the OLED. Furthermore, the previous scan signal SCAN[n−1] and the current scan signal SCAN[n] are supplied to the pixel driving part 701 in sequence, and then the pixel driving part 701 stores the data signal DATA[m], so that the pixel current generated in the pixel driving part 701 flows in the OLED in response to the emission control signal EMI[n]. Thus, the OLED emits light in response to the driving current.

In the case where it is detected whether or not the OLED is defective before the organic electroluminescent display displays an image or within a non-display period, the reverse bias control signal Vct1 having a low level is supplied to turn on the reverse bias transistor MR. Furthermore, the pixel driving part 701 does not generate the driving current. As the reverse bias transistor MR is turned on, the anode of the OLED is electrically connected to the initialization line 709. Thus, a reverse bias voltage is applied to the OLED via the initialization line 709. Preferably, a voltage difference between the anode and the cathode of the OLED ranges from −14V to −10V. More preferably, the voltage difference between the anode and the cathode of the OLED is about −12V.

With this configuration, when the OLED is defective, a leakage current flows within the OLED to which the reverse bias voltage has been applied, enabling a determination of whether or not the OLED is defective.

Figure 8A:
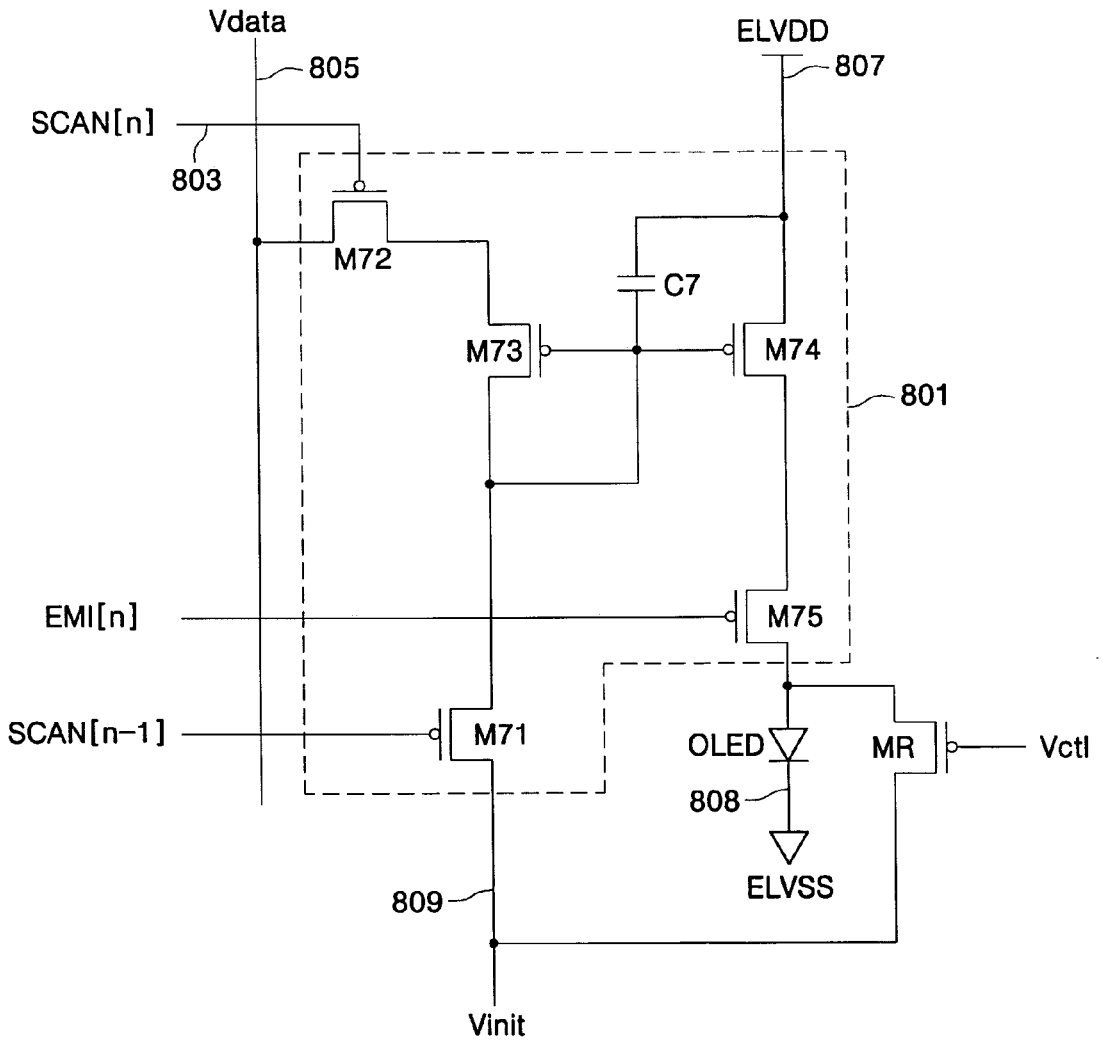
FIGS. 8A and 8B are circuit diagrams of the organic electroluminescent display according to the fourth embodiment of the present invention.
Figure 8B:
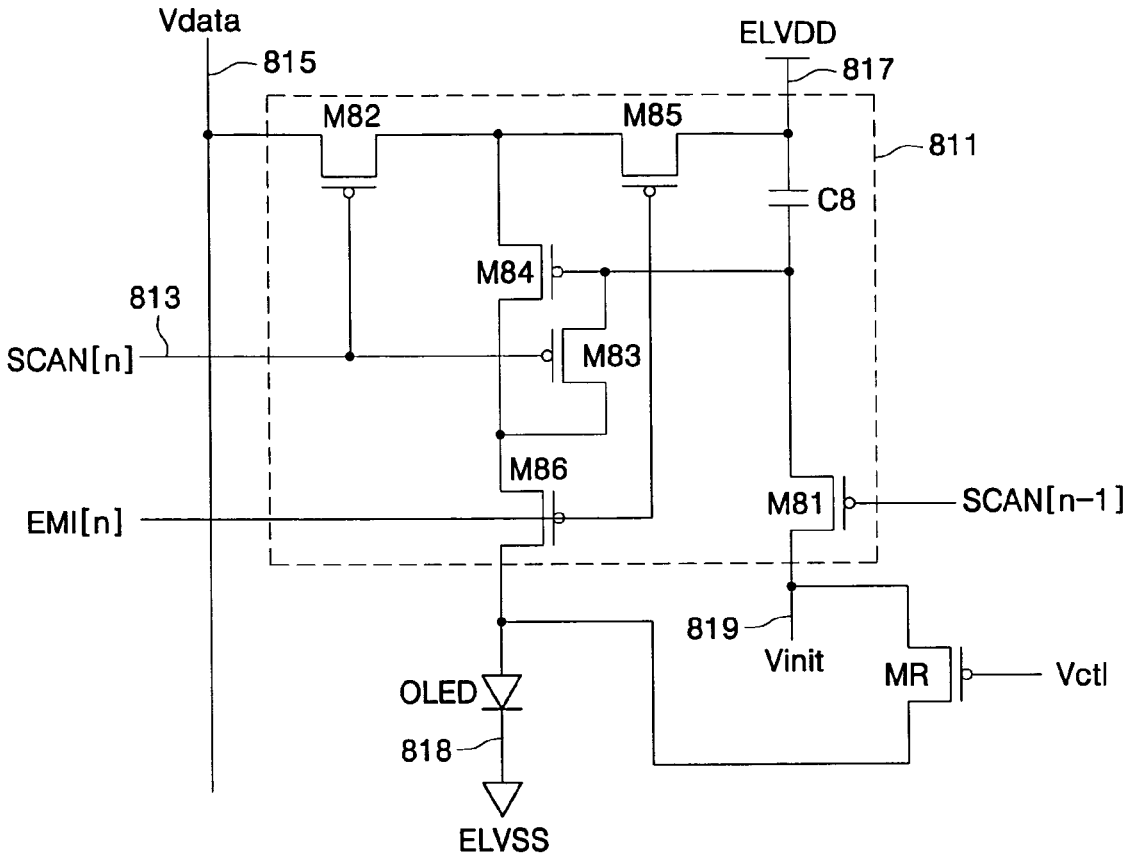

FIGS. 8A and 8B are circuit diagrams of the organic electroluminescent display according to the fourth embodiment of the present invention.

Referring to FIG. 8A, the organic electroluminescent display according to the fourth embodiment of the present invention includes a pixel driving part 801, an OLED, and a reverse bias transistor MR.

The pixel driving part 801 includes an initialization transistor M71, a switching transistor M72, a compensation transistor M73, a driving transistor M74, a capacitor C7, and an emission control transistor M75.

The initialization transistor M71 is connected between an initialization line 809 and the compensation transistor M73. The initialization transistor M71 is turned on/off in response to a previous scan signal SCAN[n−1], and supplies an initialization signal Vinit from the initialization line 809 to the capacitor C7 when it is turned on.

The switching transistor M72 is connected between a data line 805 and the compensation transistor M73. Furthermore, the switching transistor M72 is turned on/off in response to a current scan signal SCAN[n] received through a current scan line 803. When the switching transistor M72 is turned on, the data voltage Vdata is supplied to the compensation transistor M73 through the data line 805.

The compensation transistor M73 is connected between the switching transistor M72 and the initialization transistor M71. The compensation transistor M73 compensates for the threshold voltage of the driving transistor M74. Furthermore, the compensation transistor M73 includes a gate electrode and a drain electrode, which are electrically connected to each other, thereby having a connection structure like a diode. When the switching transistor M72 is turned on, the data voltage Vdata is supplied to the compensation transistor M73. If the compensation transistor M73 has a threshold voltage of "Vth1", then a voltage supplied to the gate electrode of the compensation transistor M73 due to its diode-like connection structure is "Vdata-|Vth1|".

The capacitor C7 is connected between the first power line 807 supplying a positive source voltage ELVDD and the gate electrode of the compensation transistor M73. When the switching transistor M71 is turned on, the voltage "Vdata-|Vth1|" supplied to the gate electrode of the compensation transistor M73 is stored in the capacitor C7. That is, the capacitor C7 is charged to a voltage of "ELVDD-(Vdata-|Vth1|)".

The driving transistor M74 is connected between the first power line 807 and the emission control transistor M75, and includes a gate electrode connected in common to the gate electrode of the compensation transistor M73 and one terminal of the capacitor C7. The driving transistor M74 generates a driving current corresponding to the voltage "ELVDD-(Vdata-|Vth1|)" across the capacitor C7. If the driving transistor M74 has a threshold voltage of "Vth2", then the driving current is proportional to "(Vsg-|Vth2|)2". Consequently, the driving current I can be obtained by the following Equation 1:

$$I=K(ELVDD-V\text{data}+|Vth1|-|vth2|)^2, \text{ where } K \text{ is a constant.} \quad \text{Equation 1}$$

The emission control transistor M75 is connected between the driving transistor M74 and the OLED. Furthermore, the emission control transistor M75 has a gate electrode to which an emission control signal EMI[n] is supplied. When the emission control signal EMI[n] having a low level is supplied to the emission control transistor M75, the driving current generated in the driving transistor M74 flows in the OLED, thereby making the OLED emit light.

The OLED is connected between the emission control transistor M75 and a second power line 808 supplying a negative source voltage ELVSS. When the emission control transistor M75 is turned on, the OLED emits light. Furthermore, when the reverse bias transistor MR is turned on, a reverse bias voltage is applied to the OLED.

The reverse bias transistor MR is connected between the anode of the OLED and the initialization line 809. Furthermore, the reverse bias transistor MR has a gate electrode to which a reverse bias control signal Vct1 is supplied.

When the organic electroluminescent display emits light to display an image, the reverse bias transistor MR is maintained in a turned-off state by the reverse bias control signal Vct1.

In the case where it is detected whether or not the OLED is defective before the organic electroluminescent display displays an image or within a non-display period, the reverse bias transistor MR is turned on by the reverse bias control signal Vct1. Furthermore, the pixel driving part 801 does not generate a driving current. As the reverse bias transistor MR is turned on, the anode of the OLED is electrically connected to the initialization line 809 so that the reverse bias voltage is applied to the OLED. The reverse bias voltage can be generated by supplying a voltage higher than the negative source voltage ELVSS to the second power line is 808 and supplying a voltage lower than the initialization signal Vinit to the initialization line 809.

Referring to FIG. 8B, an organic electroluminescent display has a pixel driver 811, an OLED, and a reverse bias transistor MR.

The pixel driving part 811 includes an initialization transistor M81, a first switching transistor M82, a second switching transistor M83, a driving transistor M84, a third switching transistor M85, a capacitor C8, and an emission control transistor M86.

The initialization transistor M81 is connected between an initialization line 819 and the capacitor C8. The initialization transistor M81 is turned on/off in response to a previous scan signal SCAN[n−1], and supplies an initialization signal Vinit from the initialization line 809 to the capacitor C8 when it is turned on.

The first switching transistor M82 is connected between a data line 815 and the driving transistor M84. When a current scan signal SCAN[n] having a low level is supplied via a current scan line 813, the first switching transistor M82 is turned on, and thus the data voltage Vdata is supplied from the data line 815 to the driving transistor M84.

The second switching transistor M83 is connected between the emission control transistor M86 and a gate electrode of the driving transistor M84. The second switching transistor M83 is turned on/off in response to the current scan signal SCAN [n]. When the second switching transistor M83 is turned on by the current scan signal SCAN[n], the gate electrode and a drain electrode of the driving transistor M84 are electrically disconnected from each other.

The driving transistor M84 is connected between the first switching transistor M82 and the emission control transistor M86. When the current scan signal SCAN[n] having a low level is supplied, the second switching transistor M83 is turned on, thereby allowing the driving transistor M84 to have a diode-like connection structure. The data voltage Vdata is supplied through the first switching transistor M82, so that a voltage supplied to the gate electrode of the driving transistor M84 is "Vdata-|Vth|". Therefore, the voltage "Vdata-|Vth|" is supplied to one terminal of the capacitor C8.

The third switching transistor M85 is connected between a first power line 817 supplying a positive source voltage ELVDD and a common node at which the first switching transistor M82 and the driving transistor M84 are connected. Furthermore, the third switching transistor M85 has a gate electrode to which the emission control signal EMI[n] is supplied. Thus, the third switching transistor M85 is turned on/off in response to the emission control signal EMI[n]. When the third switching transistor M85 is turned on, the positive source voltage ELVDD is supplied from the first power line 817 to the driving transistor M84, causing it to generate a driving current.

The capacitor C8 is connected between the first power line 817 and the initialization transistor M81. Furthermore, the capacitor C8 is connected to the gate electrode of the driving transistor M84. When the current scan signal SCAN[n] having a low level is supplied, the second switching transistor M83 is turned on, thereby allowing the driving transistor M84 to have a diode-like connection structure. Furthermore, the first switching transistor M82 is turned on so that the data voltage Vdata is supplied from the data line 815 to the driving transistor M84. Therefore, the voltage "Vdata-|Vth|" is supplied to both the gate electrode of the driving transistor M84 and one terminal of the capacitor C8. That is, the capacitor C8 is charged to a voltage of "ELVDD-(Vdata-|Vth|)" when the current scan signal SCAN[n] is supplied.

The emission control transistor M86 is connected between the driving transistor M84 and the OLED. Furthermore, the emission control transistor M86 has a gate electrode to which the emission control signal EMI[n] is supplied. That is, the emission control signal EMI[n] is supplied to gate electrodes of both the third switching transistor M85 and the emission control transistor M86. When the emission control signal EMI[n] having a low level is supplied, the third switching transistor M85 and the emission control transistor M86 are turned on. As the third switching transistor M85 is turned on, the positive source voltage ELVDD is supplied to the driving transistor M84, and then the driving transistor M84 generates the driving current corresponding to the data voltage Vdata, thereby compensating for the threshold voltage. The driving current generated in the driving transistor M84 flows toward the OLED via the emission control transistor M86, thereby causing the OLED to start emitting light.

The OLED is connected between the emission control transistor M86 and a second power line 818 supplying a negative source voltage ELVSS. That is, the OLED has an anode connected to both the emission control transistor M86 and the reverse bias transistor MR, and a cathode connected to the second power line 818 supplying the negative source voltage ELVSS.

The reverse bias transistor MR is connected between the initialization line 819 and the anode of the OLED. Furthermore, the reverse bias transistor MR has a gate electrode to which a reverse bias control signal Vct1 is supplied. Therefore, the reverse bias transistor MR is turned on/off in response to the reverse bias control signal Vct1.

When the organic electroluminescent display displays an image, the reverse bias transistor MR is maintained in a turned-off state. Therefore, the initialization line 819 and the OLED are electrically disconnected from each other. That is, the reverse bias voltage is not supplied to the OLED, and thus the organic electroluminescent display initializes the capacitor, stores the data voltage Vdata, and emits light, in that sequence.

However, in the case where it is detected whether or not the OLED is defective before the organic electroluminescent display displays an image or within a non-display period, the reverse bias transistor MR is turned on. Furthermore, the pixel driving part 811 does not generate a driving current. As the reverse bias transistor MR is turned on, an electrical path is formed between the initialization line 819 and the anode electrode of the OLED, thereby supplying the reverse bias voltage to the OLED. The reverse bias voltage can be generated by supplying a voltage higher than the negative source voltage ELVSS to the second power line 818 and supplying a voltage lower than the initialization signal Vinit to the initialization line 819.

In the forth exemplary embodiment, the reverse bias transistor applies the reverse bias voltage to the OLED before an image is displayed or within a non-display period. In the case where the OLED is defective, a leakage current flows within the OLED to which the reverse bias voltage has been applied, making it possible to detect whether or not the OLED is defective.

As described above, in the organic electroluminescent display according to the exemplary embodiments of the present invention, a determination is made as to whether or not the OLED is defective, not by observing an image displayed thereon, but by detecting a leakage current generated in the OLED while supplying a reverse bias voltage thereto.

Although the present invention has been described with reference to certain exemplary embodiments thereof, it will be understood by those skilled in the art that a variety of modifications and variations can be made to the present invention without departing from the spirit or scope of the present invention defined in the appended claims, and their equivalents.

What is claimed is:

1. An organic electroluminescent display arranged in a region in which a scan line and a data line intersect each other, the display comprising:

a pixel driving part connected to a first power line and adapted to receive a scan signal from the scan line and to generate a driving current corresponding to a data signal received from the data line;

an Organic Light-Emitting Diode (OLED) connected between the pixel driving part and a second power line and adapted to emit light in response to the driving current; and a reverse bias transistor connected between an anode of the OLED and a reverse bias power supply;

wherein a reverse bias voltage difference between the anode and a cathode of the OLED is in a range of from −14V to −10V.

2. The organic electroluminescent display according to claim 1, wherein the reverse bias transistor is adapted to be turned on/off in response to a reverse bias control signal, and wherein the pixel driving part is prevented from generating the driving current upon the reverse bias transistor being turned on.

3. The organic electroluminescent display according to claim 2, wherein the OLED is supplied with a reverse bias voltage upon the reverse bias transistor being turned on.

4. The organic electroluminescent display according to claim 1, wherein the pixel driving part comprises:

a first switching transistor connected to the data line and adapted to be turned on/off in response to the scan signal;

a capacitor connected between the first switching transistor and the first power line and adapted to store a voltage corresponding to a data current;

a driving transistor connected to both the first switching transistor and the first power line and adapted to generate a driving current corresponding to the voltage stored in the capacitor;

a second switching transistor connected between the driving transistor and the data line and adapted to supply the data current to the data line in response to the scan signal; and an emission control transistor connected between the driving transistor and the OLED and adapted to supply the driving current to the OLED in response to an emission control signal.

5. The organic electroluminescent display according to claim 1, wherein the pixel driving part comprises:

a switching transistor connected to the data line and adapted to be turned on/off in response to the scan signal;

a capacitor connected to the switching transistor and adapted to store the data signal received via the switching transistor; and a driving transistor connected to both the switching transistor and the first power line and adapted to generate the driving current corresponding to the data signal stored in the capacitor.

6. The organic electroluminescent display according to claim 5, wherein the data signal comprises a voltage.

7. The organic electroluminescent display according to claim 6, wherein the pixel driving part further comprises an emission control transistor connected between the driving transistor and the OLED and adapted to be turned on/off in response to an emission control signal.

8. An organic electroluminescent display, comprising:

a pixel driving part connected to a first power line and adapted to receive a scan signal from a scan line and to generate a driving current corresponding to a data signal received from a data line;

an Organic Light-emitting Diode (OLED) connected between the pixel driving part and a second power line and adapted to emit light in response to the driving current; and a reverse bias transistor connected between an anode of the OLED and the first power line and adapted to supply a reverse bias voltage to the OLED.

9. The organic electroluminescent display according to claim 8, wherein the reverse bias transistor is adapted to be turned on/off in response to a reverse bias control signal, and wherein the pixel driving part is prevented from generating the driving current upon the reverse bias transistor being turned on.

10. The organic electroluminescent display according to claim 9, wherein the OLED is supplied with a reverse bias voltage upon the reverse bias transistor being turned on.

11. The organic electroluminescent display according to claim 10, wherein a reverse bias voltage difference between the anode and a cathode of the OLED is in a range of from −14V to −10V.

12. An organic electroluminescent display, comprising:

a pixel driving part connected to a first power line and adapted to receive a scan signal from a scan line and to generate a driving current corresponding to a data signal received from a data line;

an Organic Light-Emitting Diode (OLED) connected between the pixel driving part and a second power line and adapted to emit light in response to the driving current;

a first reverse bias transistor connected between an anode of the OLED and the data line and adapted to supply a reverse bias voltage to the OLED; and a second reverse bias transistor connected between the data line and a reverse bias power supply and adapted to supply the reverse bias voltage to the first reverse bias transistor.

13. The organic electroluminescent display according to claim 12, wherein the first and second reverse bias transistors are adapted to be turned on/off in response to a reverse bias control signal, and wherein the pixel driving part is prevented from generating the driving current upon the first and second reverse bias transistors being turned on.

14. The organic electroluminescent display according to claim 13, wherein the OLED is supplied with a reverse bias voltage from the reverse bias power supply upon the first and second reverse bias transistors being turned on.

15. The organic electroluminescent display according to claim 14, wherein a reverse bias voltage difference between the anode and a cathode of the OLED is in a range of from −14V to −10V.

16. The organic electroluminescent display according to claim 15, wherein the pixel driving part comprises:

a first switching transistor connected to the data line and adapted to be turned on/off in response to the scan signal;

a capacitor connected between the first switching transistor and the first power line and adapted to store a voltage corresponding to a data current;

a driving transistor connected to both the first switching transistor and the first power line and adapted to generate a driving current corresponding to a voltage stored in the capacitor;

a second switching transistor connected between the driving transistor and the data line and adapted to supply the data current to the data line in response to the scan signal; and an emission control transistor connected between the driving transistor and the OLED and adapted to supply the driving current to the OLED in response to an emission control signal.

17. The organic electroluminescent display according to claim 15, wherein the pixel driving part comprises:

a switching transistor connected to the data line and adapted to be turned on/off in response to the scan signal;

a capacitor connected to the switching transistor and adapted to store the data signal received via the switching transistor; and a driving transistor connected to both the switching transistor and the first power line and adapted to generate the driving current corresponding to the data signal stored in the capacitor.

18. The organic electroluminescent display according to claim 17, wherein the data signal comprises a voltage.

19. The organic electroluminescent display according to claim 18, wherein the pixel driving part further comprises an emission control transistor connected between the driving transistor and the OLED and adapted to be turned on/off in response to an emission control signal.

20. An organic electroluminescent display, comprising:

a pixel driving part connected to a first power line and adapted to receive an initialization signal via an initialization line in response to a previous scan signal, to receive a data signal from a data line in response to a current scan signal, and to generate a driving current corresponding to the received data signal;

an Organic Light-Emitting Diode (OLED) connected between the pixel driving part and a second power line and adapted to emit light in response to the driving current; and a reverse bias transistor connected between the initialization line and an anode of the OLED and adapted to supply a reverse bias voltage to the OLED.

21. The organic electroluminescent display according to claim 20, wherein the reverse bias transistor is adapted to be turned on/off in response to a reverse bias control signal, and wherein the pixel driving part is prevented from generating the driving current upon the reverse bias transistor being turned on.

22. The organic electroluminescent display according to claim 21, wherein the OLED is supplied with a reverse bias voltage via the initialization line upon the reverse bias transistor being turned on.

23. The organic electroluminescent display according to claim 22, wherein a reverse bias voltage difference between the anode and a cathode of the OLED is in a range of from −14V to −10V.

24. The organic electroluminescent display according to claim 23, wherein the pixel driving part comprises:

an initialization transistor connected to the initialization line and adapted to receive an initialization signal in response to the previous scan signal;

a first switching transistor connected to the data line and adapted to receive a data signal from the data line in response to the current scan signal;

a driving transistor connected to the first switching transistor and adapted to generate a driving current corresponding to the data signal;

a second switching transistor connected between a gate electrode and a drain electrode of the driving transistor and adapted to be turned on/off in response to the current scan signal;

a third switching transistor connected between the driving transistor and the first power line and adapted to be turned on/off in response to an emission control signal;

a capacitor connected between the first power line and the initialization transistor and adapted to be initialized by the initialization signal and to store the data signal needed for generating a driving current of the driving transistor; and an emission control transistor connected between the driving transistor and the OLED and adapted to supply the driving current to the OLED in response to the emission control signal.

25. The organic electroluminescent display according to claim 23, wherein the pixel driving part comprises:

an initialization transistor connected to the initialization line and adapted to receive an initialization signal in response to the previous scan signal;

a first switching transistor connected to the data line and adapted to receive a data signal from the data line in response to the current scan signal;

a diode connected compensation transistor connected between the first switching transistor and the initialization transistor and adapted to compensate for a threshold voltage;

a capacitor connected between the compensation transistor and the first power line and adapted to be initialized by the initialization signal and to store a data signal received via the first switching transistor and the compensation transistor;

a driving transistor connected to the first power line and adapted to generate the driving current corresponding to the data signal stored in the capacitor; and an emission control transistor connected between the driving transistor and the OLED and adapted to supply the driving current to the OLED in response to an emission control signal.

* * * * *